US006899492B1

(12) United States Patent
Srinivasan

(10) Patent No.: US 6,899,492 B1
(45) Date of Patent: May 31, 2005

(54) JACKET FRAME FLOATING STRUCTURES WITH BUOYANCY CAPSULES

(76) Inventor: Nagan Srinivasan, 3323 Double Lake Dr., Missouri City, TX (US) 77459

( * ) Notice: Subject to any disclaimer, the term of this patent is extended or adjusted under 35 U.S.C. 154(b) by 0 days.

(21) Appl. No.: 10/840,116

(22) Filed: May 5, 2004

Related U.S. Application Data

(60) Provisional application No. 60/467,846, filed on May 5, 2003.

(51) Int. Cl.[7] ..... E02D 25/00; B63B 35/44

(52) U.S. Cl. ..... 405/205; 405/195.1; 405/203; 405/224; 114/264; 114/265

(58) Field of Search ..... 405/195.1, 203–208, 405/223.1, 224, 224.1–4; 114/264–266

(56) References Cited

U.S. PATENT DOCUMENTS

| | | | | | |
|---|---|---|---|---|---|
| 3,397,545 | A | * | 8/1968 | Leavitt | 114/265 |
| 3,780,685 | A | * | 12/1973 | Horton | 114/265 |
| 3,837,309 | A | * | 9/1974 | Biewer | 114/265 |
| 4,864,958 | A | * | 9/1989 | Belinsky | 114/265 |
| 5,558,467 | A | * | 9/1996 | Horton | 405/195.1 |
| 5,722,797 | A | * | 3/1998 | Horton, III | 405/224 |
| 6,206,614 | B1 | * | 3/2001 | Blevins et al. | 405/224 |
| 6,375,391 | B1 | * | 4/2002 | Børseth et al. | 405/224.4 |
| 6,503,023 | B2 | * | 1/2003 | Huang et al. | 405/206 |
| 6,564,741 | B2 | * | 5/2003 | Nelson | 114/264 |
| 6,637,979 | B2 | * | 10/2003 | Finn et al. | 405/224.2 |
| 6,652,192 | B1 | * | 11/2003 | Xu et al. | 405/195.1 |
| 6,672,803 | B2 | * | 1/2004 | Richter et al. | 405/195.1 |
| 6,718,901 | B1 | * | 4/2004 | Abbott et al. | 114/264 |
| 6,761,124 | B1 | * | 7/2004 | Srinivasan | 114/264 |

FOREIGN PATENT DOCUMENTS

| | | | | |
|---|---|---|---|---|
| JP | 57077708 | * | 5/1982 | 405/205 |

* cited by examiner

*Primary Examiner*—Jong-Suk (James) Lee
(74) *Attorney, Agent, or Firm*—Kenneth A. Roddy

(57) ABSTRACT

Jacket frame floating structures comprise one or more elongate vertical support columns formed of an open cross-braced jacket formwork of tubular members interconnected together and at least one cylindrical buoyancy capsule disposed in the open framework near an upper end and at least one cylindrical second buoyancy capsule near a lower end in vertically spaced relation. The buoyancy capsule(s) may be a single, or a plurality of upper and lower capsules bundled in circumferentially spaced relation with a central opening therethrough. Alternatively, a keel tank may replace the lower capsule. The buoyancy of the upper buoyancy capsule(s) is adjustably tuned to provide a buoyant force and a sufficient water plane area and moment of inertia required for stability of the floating structure, and the water mass and weight of the lower buoyancy capsule(s) or keel tank(s) is adjustably tuned to raise or lower the center of gravity of the entire mass of the floating structure with respect to its center of buoyancy according to ballast and variable or fixed loads including deck payloads to stabilize the structure. Alternatively, a keel tank may replace the lower capsule. The buoyancy of the upper buoyancy capsule(s) is adjustably tuned to provide a buoyant force and a sufficient water plane area and moment of inertia required for stability of the floating structure, and the water mass and weight of the lower buoyancy capsule(s) or keel tanks(s) is adjustably tuned to raise or lower the center of gravity of the entire mass of the floating structure with respect to its center of buoyancy according to ballast and variable or fixed loads including deck payloads, to stabilize the structure, and to compensate for different operational, environmental, survival and installation stages of the structure. The length of the upper buoyancy capsule(s) is sufficient so as to be partially submerged and allow oscillation of the trough and crest of waves within its top and bottom ends.

21 Claims, 5 Drawing Sheets

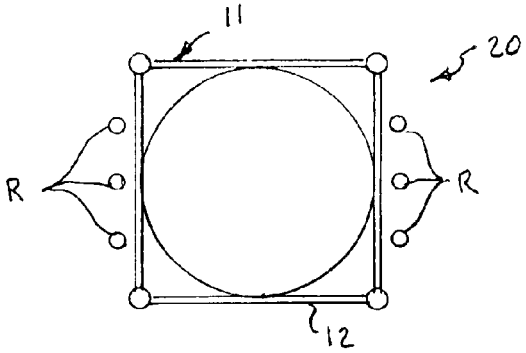
Fig. 4
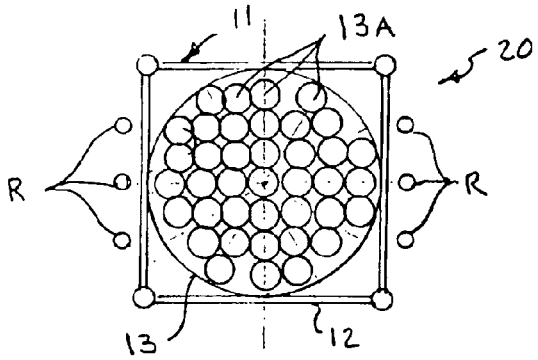
Fig. 4A
Fig. 5
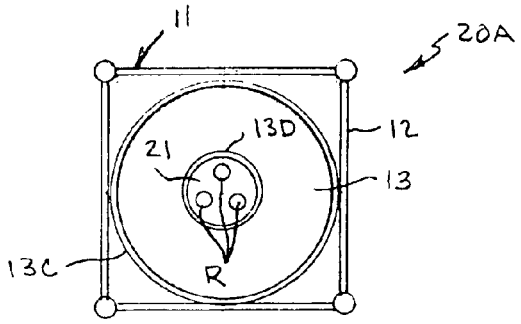
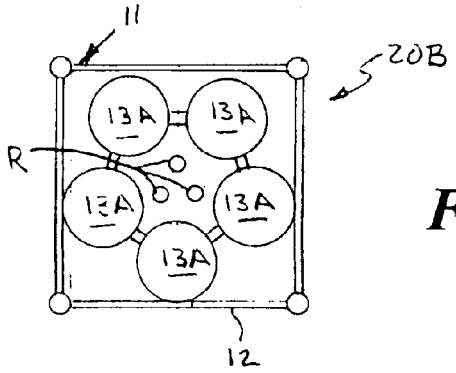
Fig. 7

JACKET FRAME FLOATING STRUCTURES WITH BUOYANCY CAPSULES

CROSS REFERENCE TO RELATED APPLICATION

This application claims priority of U.S. Provisional Application Ser. No. 60/467,846, filed May 5, 2003.

BACKGROUND OF THE INVENTION

1. Field of the Invention

This invention relates generally to offshore floating structures used in the exploration and production of offshore minerals, such as semi-submersible vessels, tension leg platforms, and spar type platforms, and more particularly to offshore floating structures having vertically spaced buoyancy capsules enclosed within an open cross-braced jacket framework or truss support structure.

2. Brief Description of the Prior Art

In the following discussion, the words "jacket" and "truss", as used herein, refers to a welded or bolted open frame structure formed of slender tubular members. A conventional truss bridges between three or more buoyant vertical column structures that stabilize a semi-submersible vessel at the water surface when floating with respect to wind, wave, current and other horizontal loads. Horizontally disposed truss structures are known as "truss pontoons", and vertically disposed truss structures are known as "truss columns".

Floating vessels and semi-submersible floating vessels, such as floating production platforms, storage and offloading vessels, tension leg platforms (TLPs) and SPAR structures, are commonly used for oil well drilling, oil production and living and working quarters. It is desirable to design floating structures with minimum heave (vertical) oscillations to waves in the ocean environment.

Conventional semi-submersible vessel or platforms comprise three or more large diameter vertical columns that are spatially separated and connected at their bottom ends by large horizontal pontoons. The deck structure is above the water with a sufficient distance between the still water level to the bottom of the deck to allow waves to pass across the columns without impacting on the bottom of the deck. The center of gravity of the entire semi-submersible vessel is generally high due to large deck loads above the water. The columns and pontoons of modern semi-submersibles are usually constructed of shells formed of thin metal plates backed with welded stiffeners, frames, stringers, bulkheads and stiffeners. The pontoon and columns have compartments for ballast, voids and storages. The columns and the pontoons provide the necessary buoyancy to the semi-submersible to accommodate the structure, equipment and live loads.

Since the center of the gravity of the semi-submersible vessel is much higher above the center of buoyancy of the lower hull, the acting moments due the wind, wave and currents horizontal forces are restored by the semi column water plane areas and moment of inertia of the water plane areas. The size and the spacing of the columns provide these two stability parameters. Thus the semi-submersible design is called a "column-stabilized floating unit". The semi-submersible vessel is a free-floating vessel compliant to wind, waves and currents. It is moored and/or dynamically positioned by powered-thrusters.

Semi-submersible vessels have good sea-keeping behavior with respect to waves and have large deck areas and carrying capacity. However the current and wind resistance results in higher positioning. A semi-submersible vessel is sensitive to the variable deck loads and its stability is limited. Semi-submersibles have large heave motions (vertical oscillation of the floating vessel) when subjected to waves and consequently a dry-tree oil production system is not feasible. In the case of a drilling semi-submersible, downtime of drilling may occur when the heave motion is not feasible for drilling.

The tension leg platform (TLP) was introduced as a new concept based on a semi-submersible design with a deck, columns or caissons and pontoons. The vertical heave of the tension leg platform (TLP) is reduced by tendons attached between the lower hull and the seabed. The tendons are always maintained in tension with the excess buoyancy designed into the lower hull. The application of a TLP is limited to water depths of say 5000 ft., over which, the tendons' vertical neutral period enters the energetic portion of the wave heave forces of the TLP. Secondly, the size of the lower hull increases the economics to always maintain tension in the tendons with respect to the increased water depth.

The SPAR is currently used in relatively large offshore oil production applications. However, the SPAR has limitations in deck area and payload due to its size. The SPAR is a single large vertical column or caisson buoyant structure that floats vertically and is stationed on location by moorings and has excellent heave performance like a TLP. Unlike the semi-submersibles, the stability of the SPAR is not dependent on the water plane area and the moment of inertia of the water plane area. The stability of the SPAR is provided by lowering its center of gravity below its center of buoyancy. Thus, the vertical buoyancy acts upwards above the center of gravity and total weight acts at the center of gravity below the center of buoyancy. Ultra deepwater posses problems to the riser tensioning system and limits the applicability of the SPAR. Mooring of the SPAR in deepwater over 5000 ft. also posses a serious problem. The effectiveness of the mooring and handling are reduced in such water depth. The SPAR also poses vortex shedding vibration problems when the vertical single column hull becomes extremely slender.

Recent SPAR designs employ a number of outer buoyancy cylinders surrounding an inner shell all interconnected at an interval along the length of the SPAR caisson. The SPAR structure is stable because the center of gravity is maintained below the center of buoyancy of the whole structure in its operation.

Typically, the SPAR hull vertical caisson structure is built in a Far East or European shipyard due to inadequate fabrication facilities in United States shipyards. The SPAR structure is then dry-towed to a location, for example, the Gulf of Mexico, commissioned quayside, and then wet-towed to the operating site and upended. The moorings are hooked up after upending on the site and topside modules are lifted onto the deck by heavy lift-crane installation-vessels.

Two types of oil production trees are used with floating production vessels or structures; dry-tree production and wet-tree production, depending upon the vertical motion of the floating vessel to the swelling of the seas due to wind. Dry-tree production is used, for example, in the deepwater offshore oil production platforms deployed in the Gulf of Mexico. Tension leg platform (TLP) and SPAR type structures are typical offshore oil production platforms that are used for dry-tree production in deepwater applications. Semi-submersible platforms are used for wet-tree productions. The dry tree platforms require a larger deck area than the wet tree production platforms.

In the case of a dry-tree production semi-submersible platform, the hull, along with a semi-finished upper deck, is typically built in a Far East shipyard and dry-towed to a location, for example, the Gulf of Mexico. The remaining topside modules are built in a U.S. shipyard and mounted on top of the deck near the shore. The platform is then towed to the operating site and hooked up to the moorings.

In either the case, the submerged hull of the SPAR or semi-submersible floating platforms are predominantly built in shipyards outside of the United States and dry-towed to U.S. waters. The cost and time involved in the fabrication and transportation of the hulls are significant in the project of an offshore oil production development, and in some marginal production fields, the conventional fabrication and transportation process is not time and cost effective.

Another important consideration is the engineering design and fabrication time involved in producing the shell-type hull floating-vessels. Generally, the engineering time is little over a year and the fabrication time is over two to three years. The conventional hull is designed to have thin shells formed of metal sheet or plates backed with welded stiffeners and transverse frames. These types of thin walled stiffened shells are susceptible to fracture and crack propagation that might lead to large catastrophic failure. Periodic inspections and maintenance are also required. Thus, the maintenance cost is increased for the shell-type hull floating vessels.

Horton, U.S. Pat. No. 5,558,467 discloses a spar-type deep water offshore floating apparatus for use in oil drilling and production in which an upper buoyant hull of prismatic shape is provided with a passage longitudinally extending through the hull in which risers run down to the sea floor, the bottom of the hull being located at a selected depth dependent upon the wind, wave, and current environment at the well site, which significantly reduces the wave forces acting on the bottom of the hull, a frame structure connected to the hull bottom and extending downwardly and comprising a plurality of vertically arranged bays defined by vertically spaced horizontal water entrapment plates and providing open windows around the periphery of the frame structure, the windows providing transparency to ocean currents and to wave motion in a horizontal direction to reduce drag, the vertical space between the plates corresponding to the width of the bay window, the frame structure being below significant wave action whereby wave action thereat does not contribute to heave motion of the apparatus but inhibits heave motion, the frame structure serving to modify the natural period and stability of the apparatus to minimize heave, pitch, and roll motions of the apparatus. A keel assembly at the bottom of the frame structure has ballast chambers for enabling the apparatus to float horizontally and for stabilization of the apparatus against tilting in vertical position, and taut anchor lines connected to the apparatus at a location of relatively little cyclic movement of the apparatus, the said lines being connected to suitable anchors.

Horton, III, U.S. Pat. No. 5,722,797 discloses a spar-type buoyant floating caisson for offshore drilling and production that includes means for increasing the natural period of the caisson and reducing heave, pitch, and roll without increasing the overall length of the caisson. The floating caisson has a center well through which drilling and/or production risers pass and one or more circular plates extend radially from the caisson below the water surface. The circular plates provide additional mass and resistance to environmentally induced motions and thus increases the natural period of the caisson beyond the periods of maximum wave energy, which allows the caisson to be designed with a shallower draft than a caisson without the plates that would normally be used in deep water.

Blevins et al, U.S. Pat. No. 6,206,614 discloses a spar-type floating offshore drilling/producing structure that is formed from a plurality of closely spaced vertically oriented buoyant columns on which one or more modules or decks may be placed to support process equipment, a drilling rig, utilities, and accommodations for personnel. The columns are held in the closely spaced relationship by a plurality of horizontal plates spaced along the length of the columns and vertical plates located near the bottom of the columns and near the top of the columns. The columns have a smaller water plane area than the horizontal plates. The structure includes fixed ballast, an oil storage area, and voids and variable ballast for offsetting the lighter weight of the stored oil.

Borseth et al, U.S. Pat. No. 6,375,391 discloses a guide device for production risers for petroleum production with a "dry tree semisubmersible" at large sea depths. The system includes a guide frame for one or more riser pipes, on a semisubmersible production vessel, with one or more main buoyancy member are arranged separately on at least one riser to carry the main part of the riser's weight. Each riser separately carries a Christmas tree on its top, near a main deck of the vessel. The guide frame comprises vertical main elements extending vertically downwards from the deck, through the splash zone and through the upper, more wave- and current-influenced zone of the sea. The guide frame also includes horizontal guide plates comprising vertically open cells formed of a horizontally arranged framework of beams. Lateral stabilization devices guide the risers' and the main buoyancy members' vertical movement relative to the vessel and restrict horizontal movement of the risers with respect to the guide frame. The guide plates are arranged in at least two levels on the guide frame. A lower guide plate is arranged at the lower ends of the vertical main elements', and a guide plate is arranged just below or near the splash zone. At least one main buoyancy member is held on the riser in level with, and guided by, lateral stabilization devices arranged in one or more guide plates below the upper, more wave- and current-influenced zone near the sea surface. The risers are without buoyancy elements through the splash zone, and thus are less exposed to the water forces in the upper zone of the sea.

Finn et al, U.S. Pat. No. 6,637,979 discloses a semisubmersible floating telescoping truss platform for use in marine environments. The truss is telescopingly mounted to the platform and movable between upper and lower positions with respect to the platform. At least one riser buoyancy member is telescopingly mounted to the platform and movable between upper and lower positions with respect to the platform. For each riser buoyancy member, at least one guide is attached to the truss and adjacent the buoyancy member for guiding and laterally restraining the buoyancy member.

The present invention is distinguished over the prior art in general, and these patents in particular by jacket frame floating structures that have one or more elongate vertical support columns formed of an open cross-braced jacket framework of tubular members interconnected together and at least one generally cylindrical buoyancy capsule disposed in the open framework near an upper end and at least generally cylindrical second buoyancy capsule therein near a lower end in vertically spaced relation. The buoyancy capsules may be a single upper and lower capsule, a plurality of upper and lower capsules bundled in circumferentially spaced relation, or upper and lower capsules having a cylindrical outer side wall and a cylindrical inner side wall defining a central opening extending therethrough. Alternatively, a keel tank may replace the lower capsule. The buoyancy of the upper buoyancy capsule(s) is adjustably tuned to provide a buoyant force and a sufficient water plane area and moment of inertia required for stability of the floating structure, and the water mass and weight of the lower buoyancy capsule(s) or keel tank(s) is adjustably tuned to raise or lower the center of gravity of the entire mass of the floating structure with respect to its center of buoyancy according to ballast and variable or fixed loads including deck payloads, to stabilize the structure, and to compensate for different operational, environmental, survival and installation stages of the structure. The length of the upper buoyancy capsule(s) is sufficient so as to be partially submerged and allow oscillation of the trough and crest of waves within its top and bottom ends.

The design and fabrication costs of the present open cross-braced tubular jacket frame structures are significantly lower than shell-type hull fabrications. Another advantage of the open cross-braced tubular jacket frame structures is that they are easily designed and fabricated as modular structures. The jacket frame and buoyancy capsules can be fabricated at different locations in the United States and assembled at shipyards in the United States to save fabrication and transportation time and cost. The design life of such jacket frame structures is longer than the conventional shell-type hull structures. The fabrication time and cost are much lower with the jacket-type frame structures. Unlike shell-type hull structures, the jacket-type frame structure has a longer corrosion resistance life because the large surface area exposed to seawater is reduced. The resistance to fatigue is also greater because the possibility of crack initiation in a stiffened shell and stress hotspots are eliminated.

SUMMARY OF THE INVENTION

It is therefore an object of the present invention to provide an offshore jacket column stabilized floating structure having buoyancy capsules enclosed within an open cross-braced jacket framework or truss support structure that can economically support a large deck area in deepwater and responds efficiently to environmental forces in ultra-deepwater.

It is another object of this invention to provide a offshore jacket column floating structure having buoyancy capsules enclosed within an open cross-braced jacket or truss framework that has a large carrying capacity and excellent heave response to wind and waves thereby making a dry-tree oil production system and marginal oil field development in deep waters economically feasible.

Another object of this invention is to provide offshore jacket column floating structures having buoyancy capsules enclosed within an open cross-braced jacket or truss framework which will eliminate the need for shell type plate hull structures with internal stiffeners and frames.

Another object of this invention is to provide offshore floating structures having buoyancy capsules enclosed within an open cross-braced jacket or truss framework that will eliminate high-risk fatigue-sensitive stress-concentration areas associated with conventional stiffened shell floating structures.

Another object of this invention is to provide offshore floating structures having buoyancy capsules enclosed within an open cross-braced jacket or truss framework that will significantly reduce engineering design and fabrication time and costs for construction, and inspection and maintenance costs throughout their lifetime.

Another object of this invention is to provide offshore floating structures having buoyancy capsules enclosed within an open cross-braced jacket or truss framework that can be easily built in shipyards or fabrication facilities based in the United States, and do not require fabrication and transport from foreign countries.

Another object of this invention is to provide offshore floating structures having buoyancy capsules enclosed within an open cross-braced jacket or truss framework that are substantially of modular construction, inexpensive to manufacture, and can be assembled quickly and inexpensively.

Another object of this invention is to provide modular open cross-braced jacket columns or truss support structures having buoyancy capsules enclosed therein that can be used to construct both SPAR type platforms and column stabilized semi-submersible floating structures.

A further object of this invention is to provide modular open cross-braced jacket columns or truss support structures having buoyancy capsules enclosed therein that are formed of lightweight high-strength materials that offer clear load paths, extended useful life, and significantly reduce the surface area exposed to seawater, compared to conventional stiffened shell floating structures.

A still further object of this invention is to provide offshore floating structures having buoyancy capsules enclosed within an open cross-braced jacket or truss framework that allows relative adjustment between the center of buoyancy and center of gravity to achieve stability when floating.

Other objects of the invention will become apparent from time to time throughout the specification and claims as hereinafter related.

The above noted objects and other objects of the invention are accomplished by the present jacket frame floating structures that have one or more elongate vertical support columns formed of an open cross-braced jacket framework of tubular members interconnected together and at least one generally cylindrical buoyancy capsule disposed in the open framework near an upper end and at least generally cylindrical second buoyancy capsule therein near a lower end in vertically spaced relation. The buoyancy capsules may be a single upper and lower capsule, a plurality of upper and lower capsules bundled in circumferentially spaced relation, or upper and lower capsules having a cylindrical outer side wall and a cylindrical inner side wall defining a central opening extending therethrough. Alternatively, a keel tank may replace the lower capsule. The buoyancy of the upper buoyancy capsule(s) is adjustably tuned to provide a buoyant force and a sufficient water plane area and moment of inertia required for stability of the floating structure, and the water mass and weight of the lower buoyancy capsule(s) or keel tnak(s) is adjustably tuned to raise or lower the center of gravity of the entire mass of the floating structure with respect to its center of buoyancy according to ballast and variable or fixed loads including deck payloads, to stabilize the structure, and to compensate for different operational, environmental, survival and installation stages of the structure. The length of the upper buoyancy capsule(s) is sufficient so as to be partially submerged and allow oscillation of the trough and crest of waves within its top and bottom ends.

BRIEF DESCRIPTION OF THE DRAWINGS

FIG. 4 is a schematic transverse cross section view of the floating offshore SPAR-type platform structure of FIG. 3 having a number of risers supported on the exterior of the vertical column jacket frame.

FIG. 4A is a schematic transverse cross section view of a modification of the floating offshore SPAR-type platform structure of FIG. 3 having a number of risers supported on the exterior of the vertical column jacket frame wherein the buoyancy capsules are formed of a plurality of smaller diameter capsules disposed with a circular outer wall.

FIG. 5 is a schematic transverse cross section view showing a modification of the floating offshore SPAR-type platform structure of FIG. 3 having a vertical column formed of an open cross-braced jacket frame with a plurality of vertical circumferentially spaced double wall buoyancy capsules enclosed therein wherein a number of risers are through the center of the buoyancy capsules.

FIG. 7 is a schematic transverse cross section view showing a modification of the floating offshore SPAR-type platform structure of FIG. 6.

DESCRIPTION OF THE PREFERRED EMBODIMENTS

Figure 1:
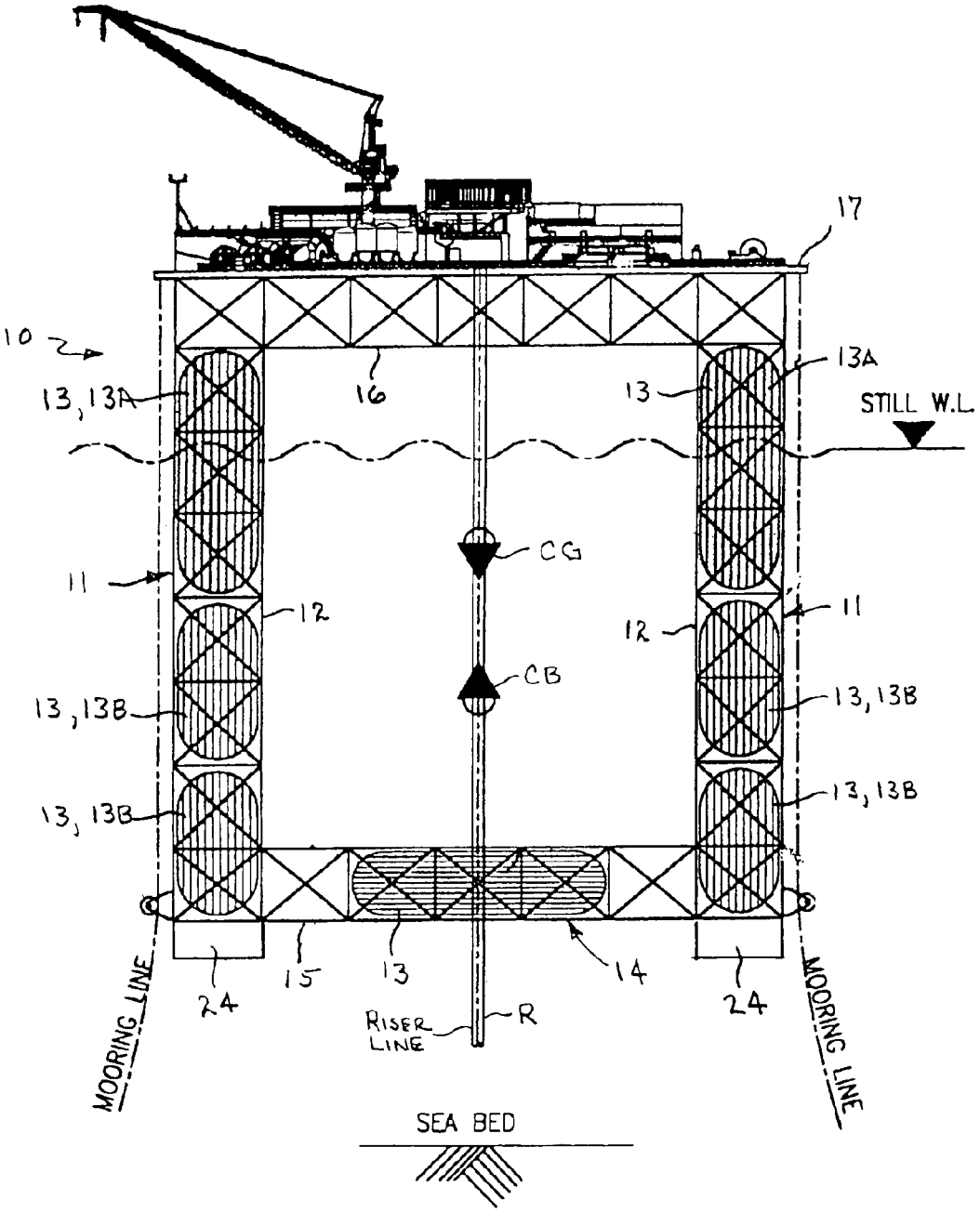
FIG. 1 is a schematic side elevation view of a floating offshore drilling and production platform structure having vertical columns formed of open cross-braced jacket frames with vertically spaced buoyancy capsules enclosed therein and horizontal truss pontoons formed of open cross-braced trusses with buoyancy capsules enclosed therein in accordance with the present invention.
Figure 2:
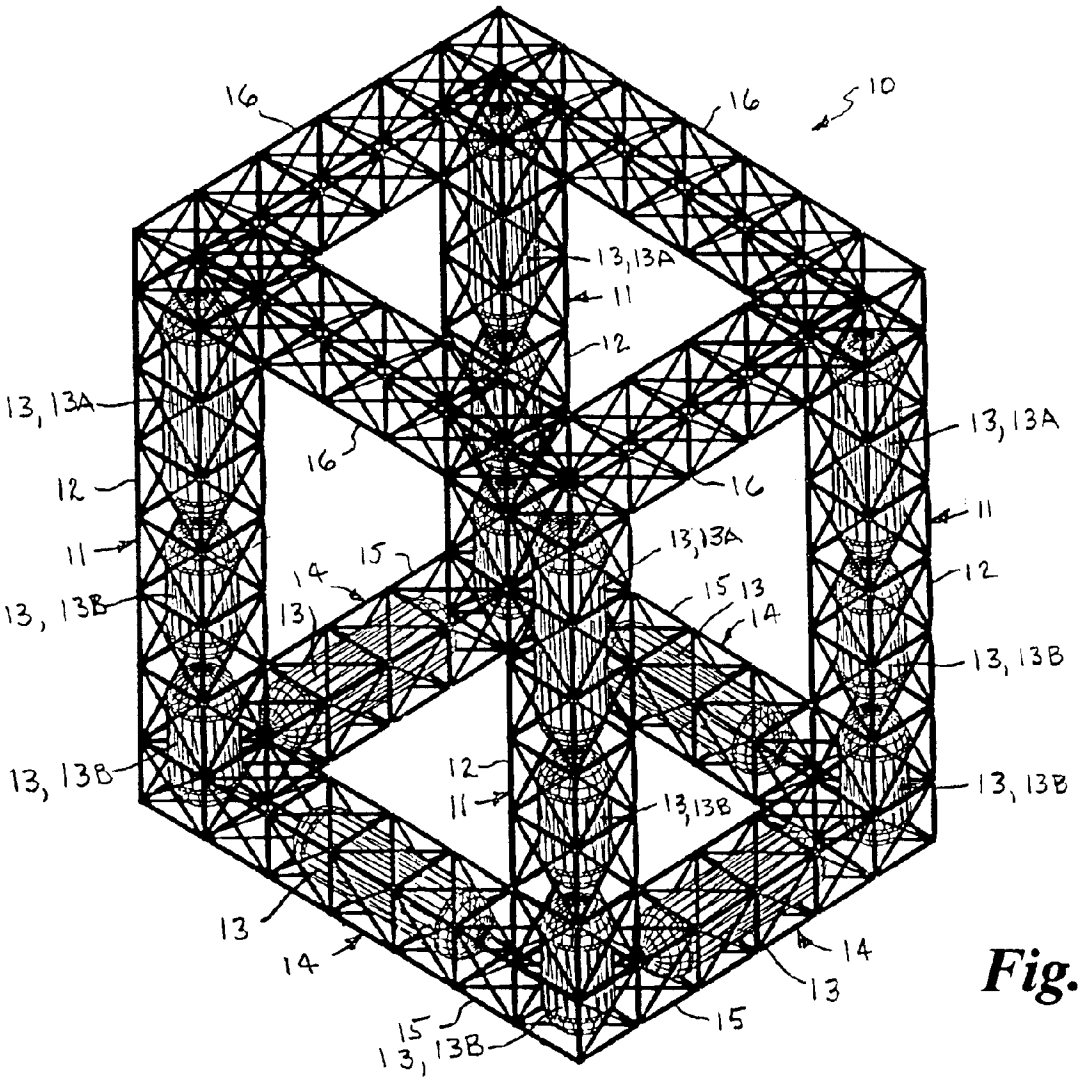
FIG. 2 is a schematic isometric view of the open cross-braced jacket column and horizontal truss pontoon frame of FIG. 1.

Referring now to FIGS. 1 and 2, there is shown, somewhat schematically, a column stabilized semi-submersible floating offshore drilling and production platform structure 10 having vertical columns 11 formed of open cross-braced jacket frames 12 with vertically spaced buoyancy capsules 13 enclosed therein and horizontal truss pontoons 14 formed of open cross-braced trusses 15 with buoyancy capsules 13 enclosed therein in accordance with the present invention. The column stabilized floating structure is similar to a semi-submersible platform and may have three or more jacket frame columns 11 interconnected at their lower ends with the open cross-braced pontoon trusses 15. In this example, the upper ends of the vertical jacket frame columns 11 are shown interconnected with horizontal open cross-braced deck support trusses 16, and a deck 17 is supported thereon. It should be understood that a conventional deck of plate construction having one or more levels may be secured to the upper ends of the vertical jacket frame columns 11, and the deck may or may not have a moonpool opening.

The open cross-braced jacket and truss frames 12 and 15 are formed of slender tubular members connected together by welding, bolting, pinning or other conventional assembly methods, and the buoyancy capsules 13 are secured within the interior of the tubular frame construction and, thus, transfer shear and axial loads to the jacket frame members. Although the open cross-braced jacket and truss frames 12 and 15 are shown as four-sided box-like configurations, it should be understood that the frames may be triangular or have three or more sides.

The buoyancy capsules 13 may be made of steel, aluminum, titanium, fiber reinforced materials, composite materials, or other suitable materials with watertight integrity suitable for marine applications. Each buoyancy capsule 13 may be made of a single cylindrical capsule or may be made of two or more cylindrical capsules of smaller diameter secured together to form a larger unitized structure. Fiber reinforced and composite materials with high specific strength provide capsules having weight to displacement ratios much lower than conventional metal hulls and significantly increase the payload capability of the present invention. Composite buoyancy capsules have reduced corrosion effects due to seawater, improved fatigue performance, ease of fabrication, domestic availability, and provide significant reduction in maintenance costs.

Figure 3:
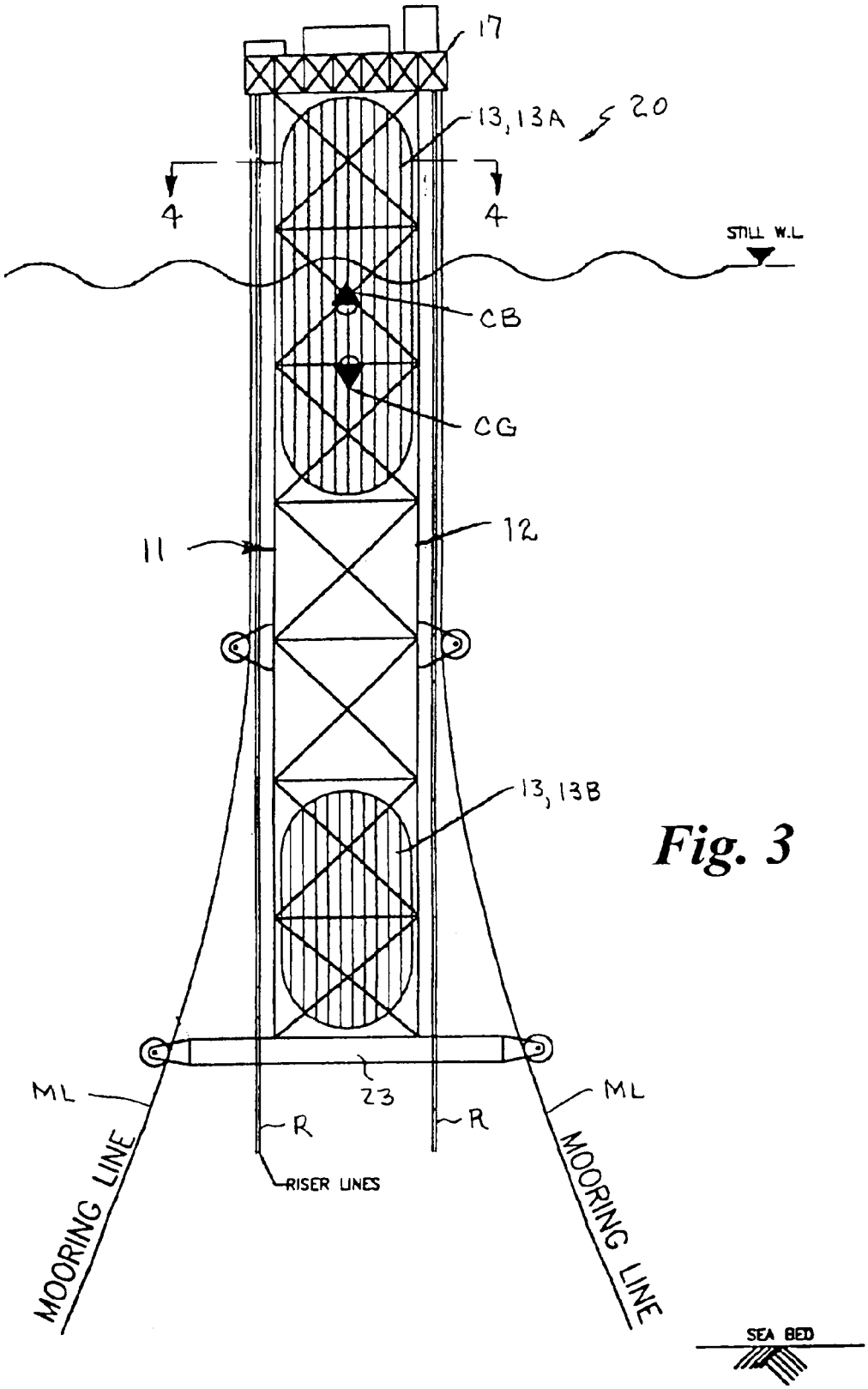
FIG. 3 is a schematic side elevation view of a floating offshore SPAR-type platform structure having a vertical column formed of an open cross-braced jacket frame with vertically spaced buoyancy capsules enclosed therein in accordance with the present invention.

FIGS. 3 and 4 show, somewhat schematically, a floating offshore SPAR-type platform structure 20 having a single vertical column 11 formed of an open cross-braced jacket frame 12 with vertically spaced buoyancy capsules 13 enclosed therein. A longer buoyancy capsule 13A is disposed at the upper end of the jacket column 11 and a shorter buoyancy capsule 13B is disposed at the lower end in vertically spaced apart relation. In this embodiment, a number of risers R are supported exterior of the vertical column jacket frame 12. A deck 17 is supported at the top end of the jacket column 11.

FIG. 4A shows, somewhat schematically, a modification of the floating offshore SPAR-type platform structure 20A of FIG. 3 wherein the vertically spaced upper and lower buoyancy capsules 13 are formed of a plurality of closely bundled smaller diameter capsules 13A enclosed within a cylindrical outer side wall 13C.

FIG. 5 shows, somewhat schematically, a modification of the floating offshore SPAR-type platform structure 20A of FIG. 3 wherein the vertically spaced upper and lower buoyancy capsules 13 have a cylindrical outer side wall 13C and a cylindrical inner side wall 13D defining a central opening 21 extending therethrough and a number of risers R are supported in the central opening.

Figure 6:
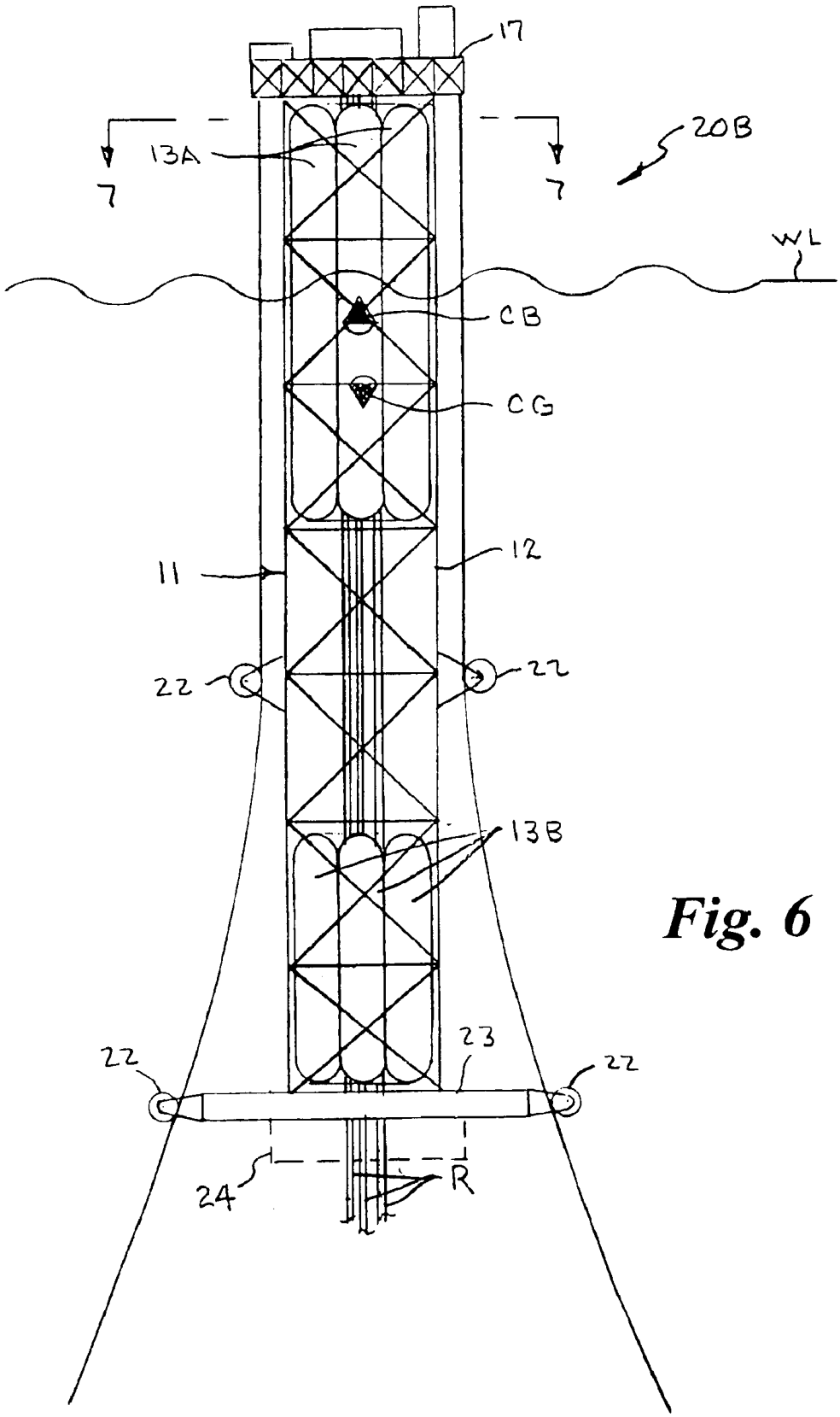
FIG. 6 is a schematic side elevation showing a another modification of the floating offshore SPAR-type platform structure of FIG. 3 having a vertical column formed of an open cross-braced jacket frame with a plurality of circumferentially spaced buoyancy capsules enclosed therein about a central opening and a number of risers are supported in the central opening.

FIGS. 6 and 7 show, somewhat schematically, another modification of the floating offshore SPAR-type platform structure 20B having a single vertical column 11 formed of an open cross-braced jacket frame 12 with a plurality of circumferentially spaced smaller diameter longer buoyancy capsules 13A enclosed at the upper end of the jacket column 11 and a plurality of circumferentially spaced smaller diameter shorter buoyancy capsules 13B at the lower end in vertically spaced apart relation. In this embodiment, a number of risers R are supported in the center of the circumferentially spaced buoyancy capsules. A deck 17 which may or may not be provided with a moonpool opening is supported at the top end of the jacket column 11.

The present floating structures may be moored and/or dynamically positioned by powered-thrusters for station keeping in the ocean environment. A base 23 may be provided at the lower ends of the vertical jacket frame column or columns 11. Conventional fairleads 22 and other hardware required for the mooring lines ML are mounted on the base or lower ends and/or sides of the jacket frame column or columns 11.

The number, size and spacing of the buoyancy capsules 13, 13A located at the upper portion of the vertical columns 11 are configured to provide and upward force and a sufficient water plane area and moment of inertia required for the stability of the floating structure. The number, size and spacing of the buoyancy capsules 13, 13B located at the lower portion of the vertical columns are configured to adjust the center of gravity "CG" of the structure with respect to its center of buoyancy "CB". The draft of the submerged hull of the structure is designed to provide suitable motion characteristics for the operation of the structure in the ocean environment. The deck structure 17 is disposed above the water with a sufficient distance between the still water level "WL" and the bottom of the deck to allow waves to pass across the columns 11 without impacting on the bottom of the deck.

Referring again to FIGS. 1 and 6, there is shown, somewhat schematically, an alternate arrangement of the column stabilized semi-submersible floating offshore drilling and production platform structure 10 and SPAR type structure 20, 20B wherein a keel tank 24 is provided at the lower ends of the vertical jacket frame column or columns 11. In this arrangement, the lowermost buoyancy capsules 13B may not be required, and the keel tanks 24 are used to adjust the center of gravity "CG" of the structure with respect to its center of buoyancy "CB".

Water may be selectively pumped into and out of the respective buoyancy capsules 13 by pumps and pump control mechanisms, which are conventional in the art, and therefore not shown. By pumping water into or out of the buoyancy capsules 13, the collective water mass of the capsules 13 and thus the weight of the structure, is adjustably tuned to raise or lower the center of gravity "CG" of the entire mass of the floating structure 10 according to ballast and other variable or fixed loads including the deck payloads.

In the example of the semi-submersible drilling and production platform structure 10 of FIG. 1, the center of gravity "CG" of the floating structure 10 is situated above the center of buoyancy "CB". In the example of the SPAR-type platform structure 20, 20B of FIGS. 3 and 6, the center of gravity "CG" of the floating structure is situated below the center of buoyancy "CB".

The center of gravity "CG" of the floating structure with respect to its center of buoyancy "CB" plays an important role in the stability and motion of the floating structure. Thus, by controlling the mass of the water in the buoyancy capsules 13 (and keel tanks 24 if provided), the center of gravity "CG" and the center of buoyancy "CB" of the floating structure can be tuned to their desired locations and to compensate for different operational, environmental survival and installation stages of the floating structure.

The uppermost buoyancy capsule(s) 13A at the upper end of the vertical jacket column or columns 11 are of sufficient length so as to be partially submerged and to provide a height of the interior air portion extending well above the crest of the maximum design wave and water immersed portion well below the through of the maximum design wave. Thus, the present floating structures are designed such that the maximum design wave will have the wave trough and crest oscillate well within the height of the uppermost buoyancy capsules at the upper end of the jacket frame column or columns.

While this invention has been described fully and completely with special emphasis upon preferred embodiments, it should be understood that within the scope of the appended claims the invention my be practiced otherwise than as specifically described herein.

What is claimed is:

1. A jacket frame offshore floating structure, comprising:

at least one elongate open cross-braced jacket frame formed of tubular members interconnected together defining an interior, and having first and second ends;

at least one first buoyancy capsule disposed in said interior near said first end adapted to be connected with ballast control means for selectively adjusting the buoyancy thereof; and weight adjusting means disposed near said second end for adjusting the weight of said structure selected from the group consisting of at least one second buoyancy capsule disposed in said interior and at least one keel tank, adapted to be connected with pump means for selectively pumping water in and out thereof; wherein the buoyancy of said at least one first buoyancy capsule is adjustably tuned to provide a buoyant force and a sufficient water plane area and moment of inertia required for stability of said floating structure; and the water mass and weight of said weight adjusting means is adjustably tuned to raise or lower the center of gravity of the entire mass of said floating structure with respect to its center of buoyancy according to ballast and variable or fixed loads including deck payloads, to stabilize the structure, and to compensate for different operational, environmental, survival and installation stages of the structure.

2. The jacket frame offshore floating structure according to claim 1, further comprising:

at least one deck platform secured to said first end of said at least one jacket frame.

3. A jacket frame SPAR type offshore floating structure, comprising:

an elongate vertical support column formed of an open cross-braced jacket framework of tubular members interconnected together defining an interior, and having upper and lower ends;

at least one generally cylindrical first buoyancy capsule having enclosed top and bottom ends disposed in said interior near said upper end including ballast control means for selectively adjusting the buoyancy thereof; and weight adjusting means disposed near said lower end for adjusting the weight of said structure selected from the group consisting of at least one second buoyancy capsule and at least one keel tank, adapted to be connected with pump means for selectively pumping water in and out thereof, wherein the buoyancy of said at least one first buoyancy capsule is adjustably tuned to provide a buoyant force and a sufficient water plane area and moment of inertia required for stability of said floating structure; and the water mass and weight of said weight adjusting means is adjustably tuned to raise or lower the center of gravity of the entire mass of said floating structure with respect to its center of buoyancy according to ballast and variable or fixed loads including deck payloads, to stabilize the structure, and to compensate for different operational, environmental, survival and installation stages of the structure.

4. The jacket frame SPAR type offshore floating structure according to claim 3, wherein said at least one first buoyancy capsule at said upper end of said vertical support column is of sufficient length to be partially submerged and allow oscillation of the trough and crest of waves within its top and bottom ends.

5. The jacket frame SPAR type offshore floating structure according to claim 3, further comprising:

a deck platform secured to said upper end of said vertical support column.

6. The jacket frame SPAR type offshore floating structure according to claim 3, further comprising:

mooring line support means on said vertical support column for supporting mooring lines thereon.

7. The jacket frame SPAR type offshore floating structure according to claim 3, further comprising:

riser support means on said vertical support column for supporting risers thereon.

8. The jacket frame SPAR type offshore floating structure according to claim 3, wherein said weight adjusting means comprises at least one generally cylindrical second buoyancy capsule having enclosed top and bottom ends disposed in said interior near said lower end in vertically spaced relation to said at least one first buoyancy capsule.

9. The jacket frame SPAR type offshore floating structure according to claim 8, further comprising:

riser support means associated with said at least one first buoyancy capsule and said at least one second buoyancy capsule for supporting risers thereon.

10. The jacket frame SPAR type offshore floating structure according to claim 8, wherein said at least one first buoyancy capsule comprises a plurality of said first buoyancy capsules disposed in circumferentially spaced relation; and said at least one second buoyancy capsule comprises a plurality of said second buoyancy capsules disposed in circumferentially spaced relation and vertically spaced relation to said plurality of said first buoyancy capsules.

11. The jacket frame SPAR type offshore floating structure according to claim 8, wherein said at least one first buoyancy capsule and said at least one second buoyancy capsules each comprise a cylindrical outer side wall and a cylindrical inner side wall defining a central opening extending therethrough.

12. The jacket frame SPAR type offshore floating structure according to claim 8, wherein said at least one first buoyancy capsule and said at least one second buoyancy capsule are formed of materials with watertight integrity suitable for marine applications selected from the group consisting of steel, aluminum, titanium, fiber reinforced materials, and composite materials.

13. The jacket frame SPAR type offshore floating structure according to claim 3, wherein said weight adjusting means comprises at least one keel tank disposed at said lower end of said vertical support column.

14. A jacket frame column-stabilized offshore floating structure, comprising:

a plurality of spaced apart vertical support columns each formed of an open cross-braced jacket framework of tubular members interconnected together defining an interior, and having upper and lower ends;

a plurality of horizontally disposed truss members each formed of an open cross-braced framework of tubular members defining an interior and first and second ends interconnecting said lower ends of said vertical support columns together in spaced apart relation;

at least one generally cylindrical first buoyancy capsule having enclosed top and bottom ends disposed in said interior near said upper ends of said vertical columns including ballast control means for selectively adjusting the buoyancy thereof; and weight adjusting means disposed near said lower ends of said vertical columns for adjusting the weight of said structure selected from the group consisting of at least one second buoyancy capsule and at least one keel tank, including pump means for selectively pumping water in and out thereof; wherein the buoyancy of said at least one first buoyancy capsule is adjustably tuned to provide a buoyant force and a sufficient water plane area and moment of inertia required for stability of said floating structure; and the water mass and weight of said weight adjusting means is adjustably tuned to raise or lower the center of gravity of the entire mass of said floating structure with respect to its center of buoyancy according to ballast and variable or fixed loads including deck payloads, to stabilize the structure, and to compensate for different operational, environmental, survival and installation stages of the structure.

15. The jacket frame column-stabilized offshore floating structure according to claim 14, wherein said at least one first buoyancy capsule at said upper ends of said vertical support columns is of sufficient length to be partially submerged and allow oscillation of the trough and crest of waves within its top and bottom ends.

16. The jacket frame column-stabilized offshore floating structure according to claim 14, further comprising:

a deck platform secured to said upper ends of said vertical support columns.

17. The jacket frame column-stabilized offshore floating structure according to claim 14, further comprising:

mooring line support means on said vertical support columns for supporting mooring lines thereon.

18. The jacket frame column-stabilized offshore floating structure according to claim 14, wherein said weight adjusting means comprises at least one generally cylindrical second buoyancy capsule having enclosed top and bottom ends disposed in said interior near said lower ends of said vertical columns in vertically spaced relation to said at least one first buoyancy capsule.

19. The jacket frame column-stabilized offshore floating structure according to claim 18, wherein said at least one first buoyancy capsule comprises a plurality of said first buoyancy capsules disposed in circumferentially spaced relation; and said at least one second buoyancy capsule comprises a plurality of said second buoyancy capsules disposed in circumferentially spaced relation and vertically spaced relation to said plurality of said first buoyancy capsules.

20. The jacket frame column-stabilized offshore floating structure according to claim 18, wherein said at least one first buoyancy capsule and said at least one second buoyancy capsule are formed of materials with watertight integrity suitable for marine applications selected from the group consisting of steel, aluminum, titanium, fiber reinforced materials, and composite materials.

21. The jacket frame column-stabilized offshore floating structure according to claim 18, further comprising:

at least one generally cylindrical third buoyancy capsule having enclosed top and bottom ends disposed in said truss members interior connected with said pump means for selectively pumping water in and out thereof, wherein;

the water mass and weight of said at least one second buoyancy capsule and said at least one third buoyancy capsule are adjustably tuned to raise or lower the center of gravity of the entire mass of the structure with respect to its center of buoyancy according to ballast and variable or fixed loads including deck payloads, to stabilize the structure, and to compensate for different operational, environmental, survival and installation stages of the structure.

* * * * *